US009321700B2

(12) United States Patent
Anderson et al.

(10) Patent No.: US 9,321,700 B2
(45) Date of Patent: Apr. 26, 2016

(54) PRODUCTION OF NANOPARTICLES USING HOMOGENEOUS MILLING AND ASSOCIATED PRODUCTS

(75) Inventors: Scott L. Anderson, Salt Lake City, UT (US); Brandon McMahon, Salt Lake City, UT (US); Jesus Paulo L. Perez, Salt Lake City, UT (US)

(73) Assignee: University of Utah Research Foundation, Salt Lake City, UT (US)

( * ) Notice: Subject to any disclaimer, the term of this patent is extended or adjusted under 35 U.S.C. 154(b) by 722 days.

(21) Appl. No.: 13/567,757

(22) Filed: Aug. 6, 2012

(65) Prior Publication Data

US 2015/0086416 A1 Mar. 26, 2015

Related U.S. Application Data

(60) Provisional application No. 61/515,256, filed on Aug. 4, 2011.

(51) Int. Cl.

| | |
|---|---|
| ***B02C 17/20*** | (2006.01) |
| ***C06B 27/00*** | (2006.01) |
| ***C06B 21/00*** | (2006.01) |
| ***C22C 21/00*** | (2006.01) |
| ***C22C 9/00*** | (2006.01) |

(Continued)

(52) U.S. Cl.

CPC ..... *C06B 27/00* (2013.01); *B02C 17/186* (2013.01); *B02C 17/20* (2013.01); *B22F 1/0018* (2013.01); *B22F 9/04* (2013.01); *C06B 21/0066* (2013.01); *C22C 9/00* (2013.01); *C22C 21/00* (2013.01)

(58) Field of Classification Search

CPC ..... B02C 17/20; B02C 17/186; C06B 27/00; C06B 21/0066; C22C 9/00; C22C 21/00; B22F 9/04; B22F 1/0003

USPC ..... 241/184, 284, 299, 176, 177, 178

See application file for complete search history.

(56) References Cited

U.S. PATENT DOCUMENTS

| | | | |
|---|---|---|---|
| 3,521,825 | A | 7/1970 | Morcom |
| 3,744,726 | A | 7/1973 | Groszek |

(Continued)

FOREIGN PATENT DOCUMENTS

| | | |
|---|---|---|
| CN | 1369338 | 9/2002 |
| CN | 101088677 | 12/2007 |

(Continued)

OTHER PUBLICATIONS

Wang, et al; "Hydrogen generation by the reaction of oxide-modified aluminum powders with tap water"; Department of Chemistry 2010.

(Continued)

*Primary Examiner* — Mark Rosenbaum

(74) *Attorney, Agent, or Firm* — Thorpe North & Western, LLP

(57) ABSTRACT

A method of producing nanoparticles can comprise milling a plurality of milling bodies sufficient to produce the nanoparticles from exterior surfaces of the plurality of milling bodies. In this manner, the milling bodies are simultaneously the milling media and the feedstock for production of nanoparticles such that additional solids are not present during milling. Nanoparticles can be readily formed and optional milling agent and capping agents can be provided to stabilize and/or customize the nanoparticles for a particular application.

22 Claims, 10 Drawing Sheets

(51) Int. Cl.

| | |
|---|---|
| ***B22F 9/04*** | (2006.01) |
| ***B02C 17/18*** | (2006.01) |
| ***B22F 1/00*** | (2006.01) |

(56) References Cited

U.S. PATENT DOCUMENTS

| | | | |
|---|---|---|---|
| 3,770,424 | A | 11/1973 | Floyd et al. |
| 3,995,815 | A | 12/1976 | Megelas |
| 3,995,817 | A | 12/1976 | Brociner |
| 4,172,720 | A | 10/1979 | Megelas |
| 4,320,204 | A | 3/1982 | Weaver |
| 4,404,023 | A | 9/1983 | Gluck |
| 4,818,567 | A | 4/1989 | Kemp, Jr. et al. |
| 6,569,262 | B1 | 5/2003 | Shohji |
| 6,604,698 | B2 | 8/2003 | Verhoff et al. |
| 6,634,576 | B2 | 10/2003 | Verhoff et al. |
| 7,135,426 | B2 | 11/2006 | Murugesh et al. |
| 7,883,995 | B2 | 2/2011 | Mitchell et al. |
| 8,091,807 | B2 | 1/2012 | Kerns |
| 2010/0124514 | A1 | 5/2010 | Chelluri et al. |
| 2010/0216632 | A1 | 8/2010 | Adzic et al. |
| 2012/0156494 | A1 | 6/2012 | Wolfrum et al. |

FOREIGN PATENT DOCUMENTS

| | | | |
|---|---|---|---|
| CN | 101948306 | | 1/2011 |
| EP | 247895 | A2 * | 12/1987 |

OTHER PUBLICATIONS

Kumaran et al.; "Nanocrystallin and amorphous structure formation in Ti—Al system during high energy ball milling"; Powder AMetallurgy 2005; vol. 48, No. 4.

Yin, et al.; "Formation Mechanism and Annealing Behavior of Nanocrystalline Ferrite in Pure Fe Fabricated by Ball Mining"; ISIJ International, vol. 41 (2001), No. 11, pp. 1389-1396.

Liu et al.; "Hydrogen generation by hydrolysis of Al—Li—Bi—NaCl mixture with pure water"; International Journal of Hydrogen Energy XXX (2011) 1-7.

Zhou, et al.; "High grain size stability of nanocrystalline Al prepared by mechanical attrition"; J. Mater. Res., vol. 16, No. 12, Dec. 2001.

Czech, et al. "Hydrogen generation through massive corrosion of deformed aluminum in water"; International Journal of Hydrogen Energy 35 (2010) 1029-1037.

Razavi-Tousi, et al.; "Production of Al nanocomposite reinforced by Fe—Al intermetallic, $Al_4C_3$ and nano-$Al_2O_3$ particles using wet milling in toluene"; Journal of Alloys and Compounds 509 (2011) 6489-6496.

* cited by examiner

03252011_EA_powder.001

| | |
|---|---|
| Diameter(nm) : | #1—785.9 nm |
| S.Dev.(nm/%) : | 117.3 nm (14.9%) |
| Percent : | 100.0 % |
| Printout ID: | EA powder |

| | | |
|---|---|---|
| Diameter(nm) : | #1—333.7 nm | #2—1204.3 nm |
| S.Dev.(nm/%) : | 45.0 nm (13.5%) | 168.0 nm (13.9%) |
| Percent : | 7.3 % | 92.7 % |

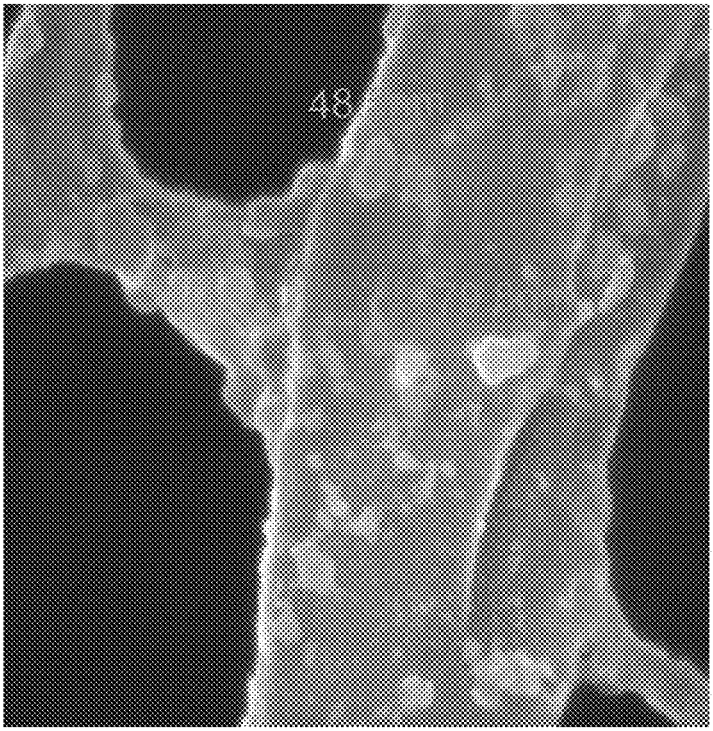
FIG. 5
SEM image of Aluminum Nanoparticles drop casted on TEM grid
FIG. 6
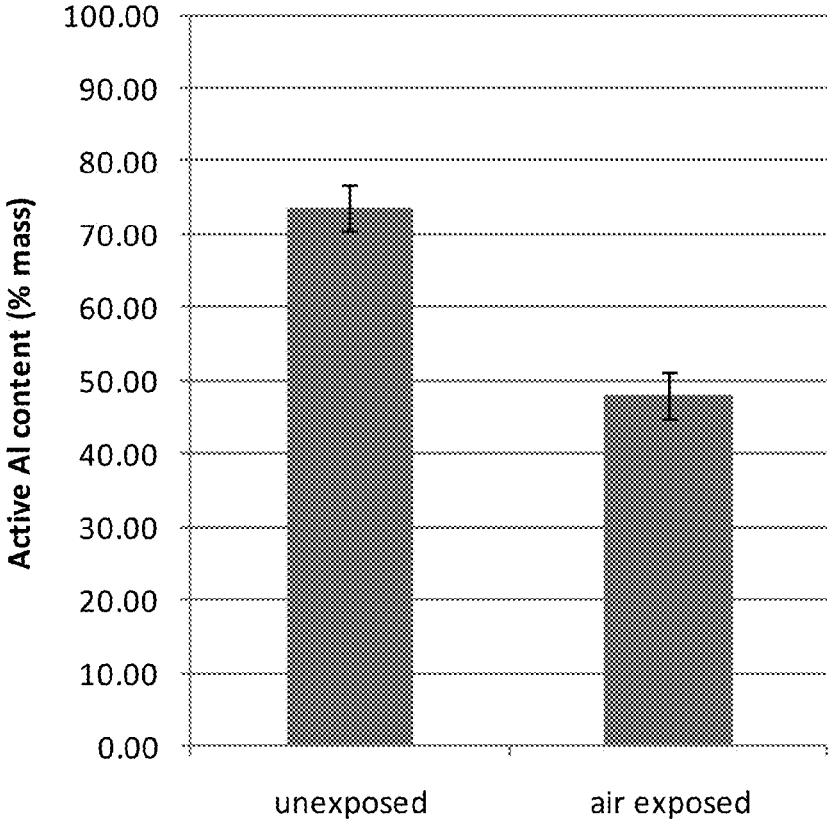

PRODUCTION OF NANOPARTICLES USING HOMOGENEOUS MILLING AND ASSOCIATED PRODUCTS

RELATED APPLICATION(S)

This application claims the benefit of U.S. Provisional Patent Application No. 61/515,256, filed Aug. 4, 2011, which is incorporated herein by reference.

GOVERNMENT INTEREST

This invention was made with government support under U.S. Air Force Office of Scientific Research Grant No. FA9550-08-1-0400. The United States government has certain rights to this invention.

BACKGROUND

Microparticles and nanoparticles can be formed using a variety of processes which vary depending on the materials and desired sizes. Mechanical milling, attritors, deposition methods, and chemical decomposition methods have all been used with varying degrees of success to produce particles of various materials. There are currently three primary competing approaches. For materials like aluminum, where the vaporization temperature is not too high, or where suitable gas-phase organometallic precursors exist, it is possible to thermally or by reactions, generate metal atoms in the gas phase, and to grow nanoparticles by controlled aggregation. The disadvantages of this approach are that the energy cost (vaporization) or reagent costs (organometallics) are high, and once the particles are generated they must separately be passivated to prevent aggregation and/or ignition upon exposure to air. Similarly, it is possible to generate nanoparticles in solution phase by decomposing precursors. These particles are typically made with a surfactant that adds solubility and protects the particles. The disadvantage is that the precursors are expensive, so that the method is not suitable for high volume application. Finally, ball milling is often used to reduce micron size powders to the nanoscale by milling the micron size powder with balls made from a heavy, hard material that crushes the micron scale powder. This method is effective for hard materials, although even for such materials there are problems with aggregation and cold-welding the particles. Cold welding refers to interaction of the surfaces of nascent nanoparticles with each other, under milling conditions, that welds the particles together, making an aggregate that is difficult or impossible to disrupt. The cold-welding problem is particularly severe for soft materials, and in addition, these materials may not mill efficiently because they are too ductile, such that the micron size particles simply deform under impact of the balls, rather than shattering. For example, if 20 micron aluminum particles are milled with stainless steel balls the average size is reduced to ~800 nm, but additional milling fails to cause any further size reduction. Furthermore, we have data showing that if we start the conventional milling process with 50 nm aluminum particles, the average particle size increases with milling (to ~1100 nm), due to cold welding.

Mechanical milling, such as ball milling, is routinely used in a wide variety of applications and involves the use of a milling media (e.g. steel or tungsten carbide balls) and a feedstock. The milling media and feedstock are vigorously mixed such that the feedstock is crushed into smaller pieces to form the desired particulate material. Although smaller particles can generally be achieved by longer milling times, there is a limit to this effect which is tempered by agglomeration of particles and mechanical limitations. Agglomeration of particles is particularly acute for ductile materials which tend to cold weld. As such, convenient and improved methods to produce micron and nanoparticles of such materials continue to be sought.

SUMMARY

A new method avoids these problems and is able to generate nanoparticles rapidly (multiple grams/hour) and is highly scalable. Coating, solubilization, and passivation can be a contemporaneous part of the milling process, not requiring additional synthetic steps.

Specifically, a method of producing nanoparticles can comprise milling a plurality of milling bodies in the presence of a milling agent, wherein the milling is sufficient to produce the nanoparticles from exterior surfaces of the plurality of milling bodies. In this manner, the milling bodies are simultaneously the milling media and the feedstock for production of nanoparticles such that additional solids are not required to be present during milling.

The nanoparticles produced by the methods of the present disclosure can be used directly or incorporated into a variety of products. For example, in one embodiment the nanoparticles can be suspended in a suitable binder for use as an explosive or propellant, or dispersed/suspended in a liquid fuel. The nanoparticles can be separated from the liquid milling matrix or left as a suspension. Furthermore, the capping agents can be chosen specifically to achieve solubility in a desired liquid as described in more detail below.

There has thus been outlined, rather broadly, the more important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

BRIEF DESCRIPTION OF THE DRAWINGS

FIG. 5 is an SEM micrograph of HMBM processed aluminum nanoparticles drop cast onto a TEM grid.

FIG. 6 is a graph illustrating the active (non-oxidized) aluminum content.

Figure 1:
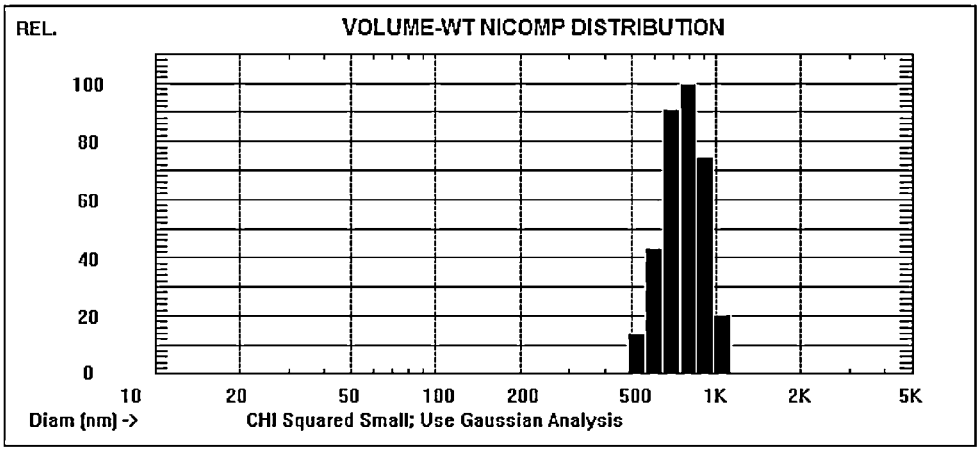
FIG. 1 is a particle size distribution for 20 μm feedstock milled in a conventional manner.

These drawings are provided to illustrate various aspects of the invention and are not intended to be limiting of the scope in terms of dimensions, materials, configurations, arrangements or proportions unless otherwise limited by the claims.

DETAILED DESCRIPTION

While these exemplary embodiments are described in sufficient detail to enable those skilled in the art to practice the invention, it should be understood that other embodiments may be realized and that various changes to the invention may be made without departing from the spirit and scope of the present invention. Thus, the following more detailed description of the embodiments of the present invention is not intended to limit the scope of the invention, as claimed, but is presented for purposes of illustration only and not limitation to describe the features and characteristics of the present invention, to set forth the best mode of operation of the invention, and to sufficiently enable one skilled in the art to practice the invention. Accordingly, the scope of the present invention is to be defined solely by the appended claims.

In describing and claiming the present invention, the following terminology will be used.

The singular forms "a," "an," and "the" include plural referents unless the context clearly dictates otherwise. Thus, for example, reference to "a nanoparticle" includes reference to one or more of such materials and reference to "subjecting" refers to one or more such steps.

As used herein with respect to an identified property or circumstance, "substantially" refers to a degree of deviation that is sufficiently small so as to not measurably detract from the identified property or circumstance. The exact degree of deviation allowable may in some cases depend on the specific context.

As used herein, term "milling bodies" refers to a plurality of solid materials that can be milled together as a source material to produce nanoparticles. Milling bodies can be of any general shape such as spherical, cubical, cylindrical, etc.

As used herein, "milling agent," "milling solvent" and "wetting agent" are used interchangeably and refer to a solvent material that is present with the milling bodies during milling.

As used herein, the term "homogeneous milling" refers generally to a milling process in which the milling media acts simultaneously as the milling feedstock.

As used herein, the term "compositionally homogeneous," such as used in connection with a milling body, refers to a material that is compositionally uniform throughout the body.

As used herein, the term "relative polarity" refers to solvent polarity of a compound and specifically the normalized molar transition energy, $E_T^N$, (see Christian Reichardt, Solvents and Solvent Effects in Organic Chemistry, Wiley-VCH Publishers, Chapter 7.4, 3rd ed., 2003).

As used herein, the term "nanoparticle" refers to a particle having an average diameter of less than about 500 nm. In one embodiment, a nanoparticle can have an average diameter of less than about 200 nm. In another embodiment, a nanoparticle can have an average diameter of less than about 150 nm.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a numerical range of about 1 to about 4.5 should be interpreted to include not only the explicitly recited limits of 1 to about 4.5, but also to include individual numerals such as 2, 3, 4, and sub-ranges such as 1 to 3, 2 to 4, etc. The same principle applies to ranges reciting only one numerical value, such as "less than about 4.5," which should be interpreted to include all of the above-recited values and ranges. Further, such an interpretation should apply regardless of the breadth of the range or the characteristic being described.

Any steps recited in any method or process claims may be executed in any order and are not limited to the order presented in the claims. Means-plus-function or step-plus-function limitations will only be employed where for a specific claim limitation all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given herein.

Figure 2:
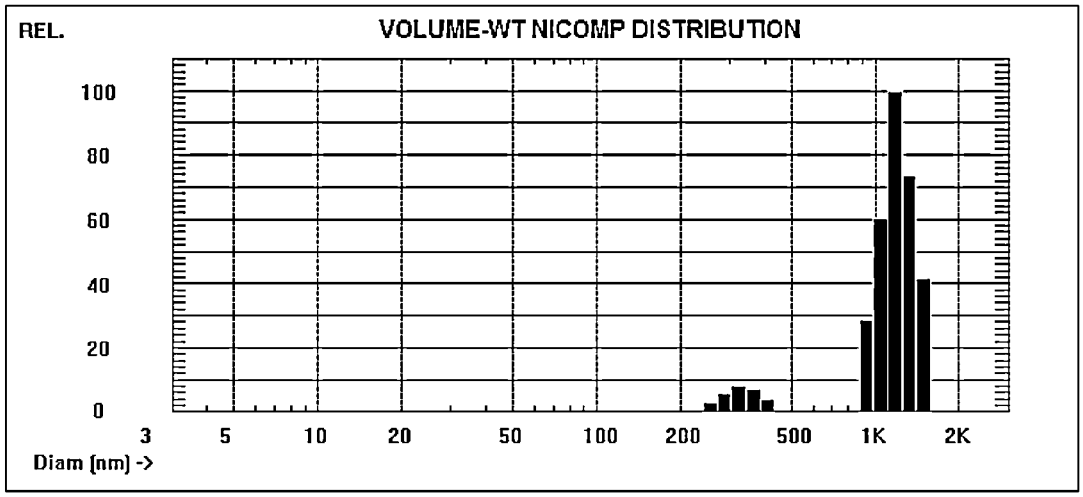
FIG. 2 is a particle size distribution for 50 nm feedstock milled in ethanol in the conventional manner.
Figure 3:
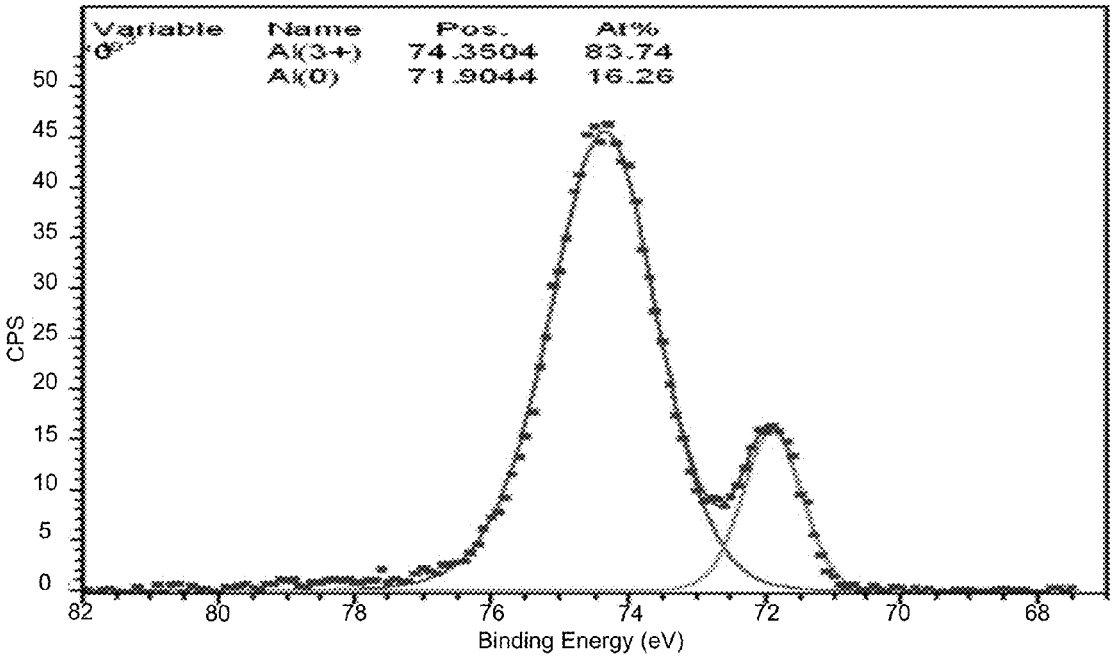
FIG. 3 is an XPS of the milled nanoparticles showing a high proportion of oxidized aluminum.
Figure 4:
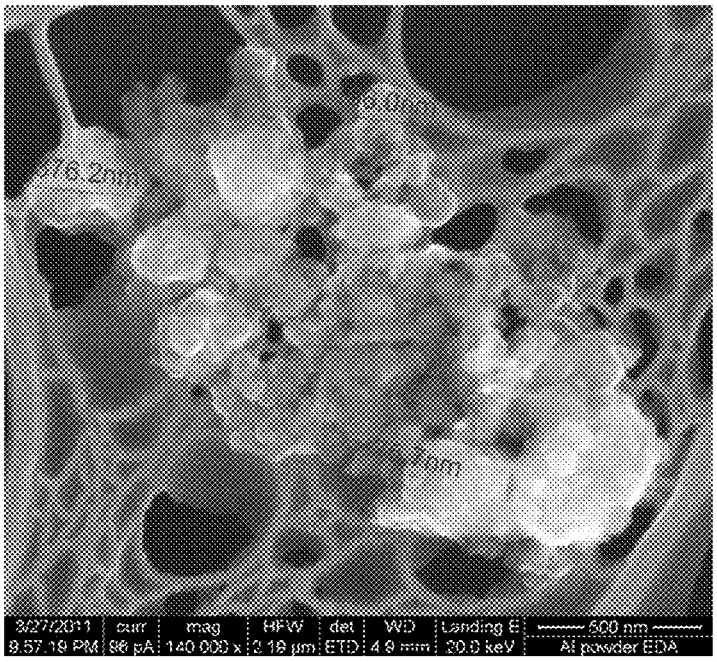
FIG. 4 is an SEM micrograph of cold-welded aluminum nanoparticles formed during conventional milling of 50 nm aluminum feedstock.

Soft metals like aluminum do not crush well. Frequently, milling and crushing merely allows such soft metal particulates to agglomerate and/or cold-weld to form larger particles rather than smaller particles. This cold-welding effect has been observed when using standard ball milling of 50 nm aluminum feedstock and steel balls. FIG. 1 is a size distribution graph for 20 μm aluminum powder feedstock milled in conventional manner. FIG. 2 is a size distribution graph for 50 nm feedstock milled in ethanol. FIG. 3 is an XPS of the resulting aluminum particles which illustrates the high proportion of oxidized aluminum. The SEM micrograph of FIG. 4 shows aluminum particles which are cold-welded to form aggregates which are larger than the starting materials.

With all of the above in mind, the present disclosure provides a method of producing nanoparticles. The method can include milling a plurality of milling bodies in the presence of a milling agent. The milling is sufficient to produce the nanoparticles from exterior surfaces of the plurality of milling bodies. In this manner, the milling bodies are simultaneously the milling media and the feedstock for production of nanoparticles such that additional solids are not required to be present during milling. In the new method, nanoparticles can be prepared by milling, using bodies that are made of, or coated with the material of interest. The material for the nanoparticles is worn directly from the surfaces of the bodies during milling in the presence of a milling agent, while other components, such as a capping agent, can optionally be present. One advantage of this method is efficient production of small nanoparticles with controlled and narrow size distributions, from soft ductile materials such as aluminum, which do not mill well in the conventional approaches. Multimodal distributions and/or broad size distributions can optionally be further narrowed by an additional separation step such as sedimentation. This approach also works well for harder materials such as iron. For materials that are inexpensive and available as small solid compositionally homogeneous bodies, such as balls (e.g. aluminum, copper, iron, etc.), the method can be done with these solid bodies of the material of interest. For materials that are not available as compositionally homogeneous solid bodies, or for which preparation of compositionally homogeneous solid bodies would be expensive (e.g. precious metals), the material can be plated onto the surface of base metal bodies (e.g. steel).

The homogeneous media milling methods can be particularly effective for producing nanoparticles of ductile metals. As such, in one aspect, ductile metals can have a modulus of plasticity from about 10 GPa to about 220 GPa. However, a wide variety of other metals and other materials can also be used. For example, the process can be applied to ductile soft metals, ductile hard metals, and non-ductile metals. Non-limiting examples of metals of which the nanoparticles can be produced include aluminum, iron, steel, gold, palladium, platinum, silver, nickel, chromium, zinc, oxides thereof, and alloys thereof. Other materials that can also be used include ceramics, hard polymers, and other non-metal materials from which it might be desirable to make nanoparticles. Metals that are of particular interest can include aluminum, copper, gold, silver, platinum, iron, and nickel.

The plurality of milling bodies can be provided as solids which are compositionally homogeneous. Alternatively, the plurality of milling bodies can be core-shell structures. For example, a core material can be coated with a shell material having a different composition. In one aspect, exterior surfaces of the core-shell structure can be formed of a precious metal. This can allow for substantial cost savings by using readily available core materials and can allow for tailoring of ball surface hardness. In some cases, the core can have a higher hardness than the shell material. For example, gold is relatively soft while a steel core can provide a substantial increase in hardness of a core-shell structure compared to a solid gold ball. The shell material can be any thickness sufficient to produce nanoparticles therefrom, although a general guideline can be from about several microns to 1 mm thickness. Varying the density of the milling bodies can also be desirable to optimize particle size distribution. By varying density one can vary the centrifugal force that each ball is subject to when in contact with other balls, which can have an effect on the abrading efficiency. Core-shell structures can thus be adjusted in shell thickness and compositions in order to optimize resulting particle size distribution.

Often, each of the plurality of milling bodies can be formed of a common material. In such cases, the resulting nanoparticles can have a composition which matches the original exterior surfaces of the plurality of milling bodies. In one alternative, the plurality of milling bodies can include multiple different types of materials such that the resulting nanoparticles are either alloyed nanoparticles, multi-component composite nanoparticles, or multimetallic nanoparticles. In one aspect, the plurality of milling bodies can include a first plurality of milling bodies having exterior surfaces of a first metal and a second plurality of milling bodies having exterior surfaces of a second metal which is different than the first metal, such that the nanoparticles formed after milling comprise both the first and second metals.

The milling bodies can be shaped in any suitable geometry to facilitate milling and removal of material from exterior surfaces of the milling bodies. In one embodiment, the milling bodies can be substantially spherical. In another embodiment, the milling bodies can be substantially cylindrical. Other non-limiting examples of suitable milling body shapes can include spheroid, ellipsoid, banded spheres, cubes, triangular, tetrahedral, polygonal, or the like. The size of the milling body is not particularly limited and can be a function of desired production volume and available milling container sizes. Generally, a larger initial size will result in a larger production output of nanoparticles. However, in one aspect, the plurality of milling bodies can have an initial size such that the largest dimension (e.g. diameter, length, width, etc.) is about 0.10 inch to about 0.5 inch, or 0.125 inch to about 0.3125 inch, and in one case about 0.1875 inch. In one embodiment, the milling body can be substantially spherical (i.e. milling balls) and can have a diameter of about 0.125 inch to about 0.3125 inch.

A milling agent can be included to provide a liquid milling matrix in which the milling bodies and nanoparticles can be milled. Without being limited by theory, it is believed that the milling agent can be chosen to provide a heat transfer mechanism to evenly distribute and/or dissipate heat, as well as protect newly formed nanoparticles from agglomeration or oxidation. In one embodiment, the milling agent can be free of oxygen or oxygen-containing components. Removal of oxygen-containing components can prevent oxidation of newly formed nanoparticles during milling. Further, the milling agent can be polar and substantially chemically non-reactive with the nanoparticles and the plurality of milling bodies. The specific choice of milling agent can depend on the particular nanoparticles being formed, and the desired surface coating or dispersibility characteristics. However, non-limiting examples of suitable milling agents include at least one of acetonitrile, methylene chloride, hexane or other organic solvents, ethanol, water, benzylamine, ionic liquids (e.g. MAT dicyanamide (DCA)), alcohols, and the like. In one specific aspect, the milling agent is acetonitrile. In another specific aspect, the milling agent is a liquid fuel or propellant that it is desired to suspend the nanoparticles in, such as JP-5, JP-8, or an ionic liquid propellant.

It has been discovered that some milling solvents are more suitable and effective for use under the disclosed methods. Specifically, solvents that are polar and/or include at least one moiety of a carboxylic acid, a ketone, an alcohol, a nitrile, an amine, or combinations thereof provide meaningfully higher rates of nanoparticle production. In one embodiment, the milling agent is substantially non-reactive with the nanoparticles and the milling bodies. By non-reactive it is meant that the milling agent does not react with the nanoparticles and/or milling bodies. Solvents that have electrostatic, or van der Waals interactions and/or readily reversible reactions between the milling agent and the nanoparticle and/or milling bodies can be considered to be non-reactive. It has been discovered that the polarity of the compound plays a role in the compounds ability to facilitate the production of nanoparticles. In one embodiment, the milling agent can have a dipole moment of greater than 0.0. In another embodiment, the milling agent can have a dipole moment of greater than 0.3. In a further embodiment, the milling agent can have a relative polarity of at least 0.09. In still a further embodiment, the milling agent can have a dipole moment of greater than 0.0 and a relative polarity of 0.09. Examples of functional and non-functional solvents, their dipole moments and relative polarities are shown below in Table I. It is noteworthy that the dipole moment and density of any given compound are values that are known or could be determined by one of ordinary skill in the art. As such, the below listed value are not intended to limit the solvents which can be used as milling agents under the present invention.

TABLE I

| Solvent | Density (g/mL) | Dipole Moment |
|---|---|---|
| Pentane | 0.626 | 0 |
| Hexane | 0.655 | 0 |
| Heptane | 0.684 | 0 |
| Toluene | 0.867 | 0.375 |
| Benzene | 0.879 | 0 |
| Diethylamine | 0.706 | 0.92 |
| 3-Pentanone | 0.814 | 2.7 |
| Methylene Chloride | 1.326 | 1.6 |
| Acetone | 0.786 | 2.88 |
| Acetonitrile | 0.786 | 3.92 |
| Ethanol | 0.789 | 1.69 |

The methods of the present disclosure can be used with a variety of metals. Many metals are highly reactive in oxygen environments, especially as particle size decreases. In such cases, a capping agent can be added which binds to the nanoparticles sufficient to substantially reduce oxidation of exposed surfaces of the nanoparticles. The milling or wetting agent is found to be helpful in distributing heat and preventing the nascent nanoparticles from aggregating or cold-welding. Similarly, a capping agent is a material (e.g. oleic acid, organic amines, ionic liquids, thiols, and the like) that will bind to the surface of the nanoparticles, rendering them soluble/suspendible or miscible in different materials such as solvents, liquid fuels, rocket propellants, biological fluids, and polymeric pyrotechnic or propellant binders. In addition, the capping agent may be designed to protect the particle surface so that particles can be passivated against oxidation or other reactions in the environment.

Generally, the nanoparticles can be exposed to the capping agent at any time after their formation. Thus, in one aspect, the capping agent can be added during the milling. When capping agent is added during milling, care can be taken to avoid any oxygen-containing groups from substantially oxidizing surfaces. Rather, any oxygen or nitrogen groups can be chosen to bind with the nanoparticle surfaces. Such binding can be relatively weak sufficient to allow the capping agent to be burned off during use (e.g. as an explosive or fuel additive). As a general guideline, capping agent can be provided in a sufficiently low proportion to milling agent to prevent oxidation upon exposure to air as well as prevent aggregation of the nanoparticles and promote surface chemistry between the nanoparticles and solvent. This allows the milling agent to perform primarily as a medium in which nanoparticles flow and impact one another and the milling bodies without substantial interference from capping agent. The capping agent is available to weakly bind with newly created surfaces as smaller nanoparticles are produced. The amount of capping agent can, for example, be a slight (~5-10%) excess needed to coat the produced nanoparticles. Although the proportions can vary considerably depending on the materials and intended applications, a general guideline is providing capping agent at about 0.1 vol % to about 20 vol % of the liquid milling matrix (liquids not including milling bodies or nanoparticles). Most often the capping agent can comprise from about 2.5 vol % to about 10 vol % of the liquid milling matrix.

Suitable capping agents can be chosen to allow dense packing across nanoparticle surfaces while also providing solubility in a desired fuel or other product matrix. In another embodiment, the capping agent can be added subsequent to the milling. In still a further embodiment, a capping agent can be added during milling, and an additional quantity of the same or a different capping agent can be added subsequent to milling. Suitable capping agents can depend largely on the specific material of the nanoparticles and on the desired application. Non-limiting examples of capping agents include at least one of oleic acid, octanethiol, dodecanethiol, 3,4-ethylenedioxythiophene, mercaptohexanoic acid, 1-mercapto-(triethylene glycol)methyl, polyhedral oligomeric silsesquioxane (POSS)-based amine, polyvinyl alcohol, sodium carboxymethylcellulose (CMC), polyvinylpyrrolidone (PVP), folic acid, tetradecyltrimethylammonium bromide (TTAB), oleylamine, sodium acrylate, citrate, starch, dodecylamine, benzylamine, carboxylic compounds, amines, thiols, and the like. It is noteworthy that some solvents can function simultaneously as a capping agent and as a milling agent.

This method has been applied to making large volumes of high energy density aluminum nanoparticles, and can be applied to many other metals. For example, there is substantial interest in gold nanoparticles for biomedical applications, and of other metal nanoparticles as catalysts. Iron (and other metal) nanoparticles also have potential for use as oxygen scavengers for fuel systems. In order to avoid oxidation of the particles for materials (e.g. aluminum) that have a high affinity for oxygen, it is necessary to prepare the milling materials in a glove box, although this is also the case for other synthesis methods.

The invention allows rapid production of multi-gram quantities of nanoparticles of soft or ductile metals with controlled and narrow size distribution, optionally coated with a capping agent that controls solubility/dispersibility in various media including polar and non-polar organic solvents, aqueous solutions, and polymers. The capping agent also controls access of environmental molecules (e.g. oxygen, water) to the particle surface. As such, the capping agent passivates the surface so that it does not, for example, oxidize upon air exposure or in storage. Although oxidation can still occur if oxygen contamination is present, unoxidized particles can be obtained at from about 60% to about 100% yield of the total particles produced. This method has been applied to making large volumes of high energy density aluminum nanoparticles, and can be applied to many other metals. These aluminum particles also have the ability to split water generating hydrogen. The method has also been used for harder materials, such as iron, and can be applied to most metals, including noble metals of interest as catalysis or as biomedical tracers/imaging agents (e.g. gold).

As a general guideline, increases in surface area also result in increases in viscosity which can affect mixability of suspensions and/or slurries of particles and associated milling processes. The choice of milling agent can be a function of the specific materials and can affect results. For example, the use of hexane as a milling agent can often allow for larger particles.

One particular application is the use of non-oxidized particles. Many of these metals quickly oxidize when exposed to air or other oxygen-containing compounds. Oxidation rates are accelerated as particle size decreases (i.e. increased surface area). In some cases exposure of such non-oxidized particles to air can result in spontaneous ignition. Using the methods described herein, stabilized non-oxidized particles can be provided which can be used in explosives and propellant binders. In such applications it can be desirable to suspend the particles in a suitable fuel or other liquid propellant, or to improve dispersibility of particles in a binder for solid propellant or explosive applications. For example, hexane can be effectively used. In another example, ionic liquids can be used as a suspension media for use in rocket propellants for use in launching satellites or other vehicles.

Although additional materials can be added to the milling matrix, most often the process can be effective using only milling bodies and a milling agent, and optionally a capping agent. As such, the milling may be substantially free of added solids other than the plurality of milling bodies. The milling can be sufficient to produce nanoparticles, particularly those having diameters of 500 nm or less. In one embodiment, the nanoparticles produced by the method can have an average diameter of less than about 200 nm. In another embodiment, the nanoparticles produced by the method can have an average diameter of less than about 150 nm. In yet other embodiments, the nanoparticles produced can be from about 1 nm to about 50 nm, and some cases less than 30 nm.

Although milling conditions can vary, as a general guideline, milling times can range from about 15 to about 3600 minutes while milling rates can vary from about 1 to about 400 rpm. In preparing these for a solid rocket propellant the nanoparticles can be prepared with the appropriate surface chemistry to disperse them in a desired concentration in a liquid constituent of the fuel. The liquid suspension is then polymerized to form the solid propellant. For ionic liquids, they are prepared with the appropriate surface chemistry to be dispersed in the ionic liquid, such as with one constituent of the respective ionic liquid.

The milling done using the methods disclosed herein can be performed using a variety of milling devices known in the art so long as the device causes the milling bodies to abrade each other. Non-limiting examples of mill types that can be used include planetary mills and shaker mills. Some mill types may be more advantageously used when the disclosed method is scaled to commercial levels. Other mill types can also be used.

Figure 10:
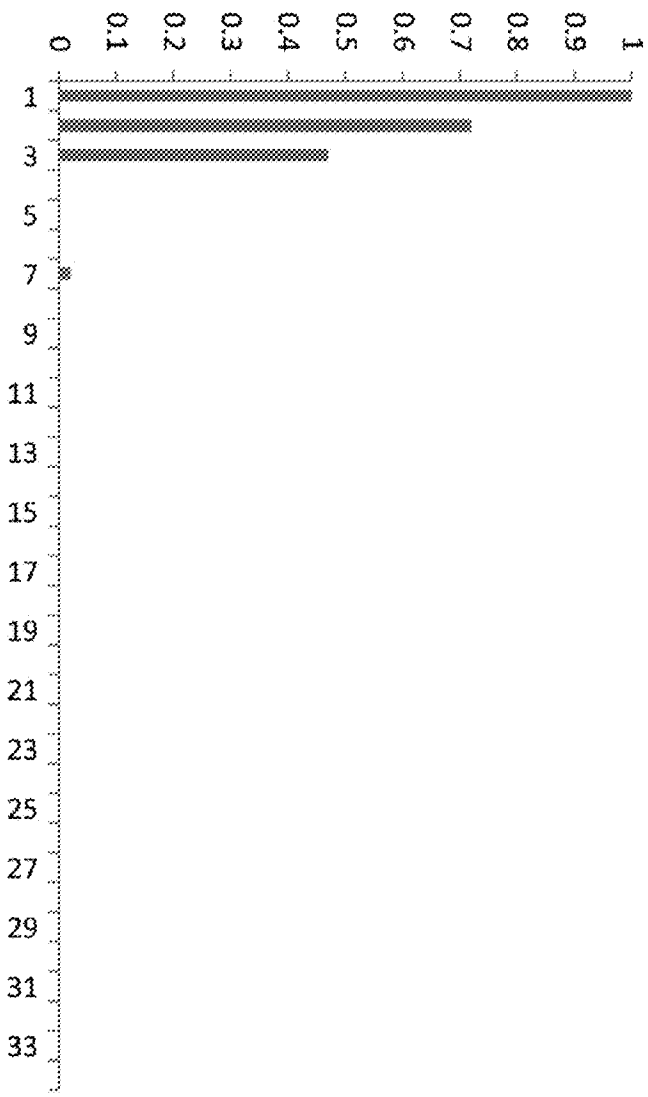
FIG. 10 is a particle size distribution following use of one embodiment of the method of the present disclosure. Particles generated by milling of aluminum in acetonitrile at 350 rpm for 3 hours, then extracted from the milling dispersion using oleic acid. Small particles recovered from first oleic acid extraction.
Figure 11:
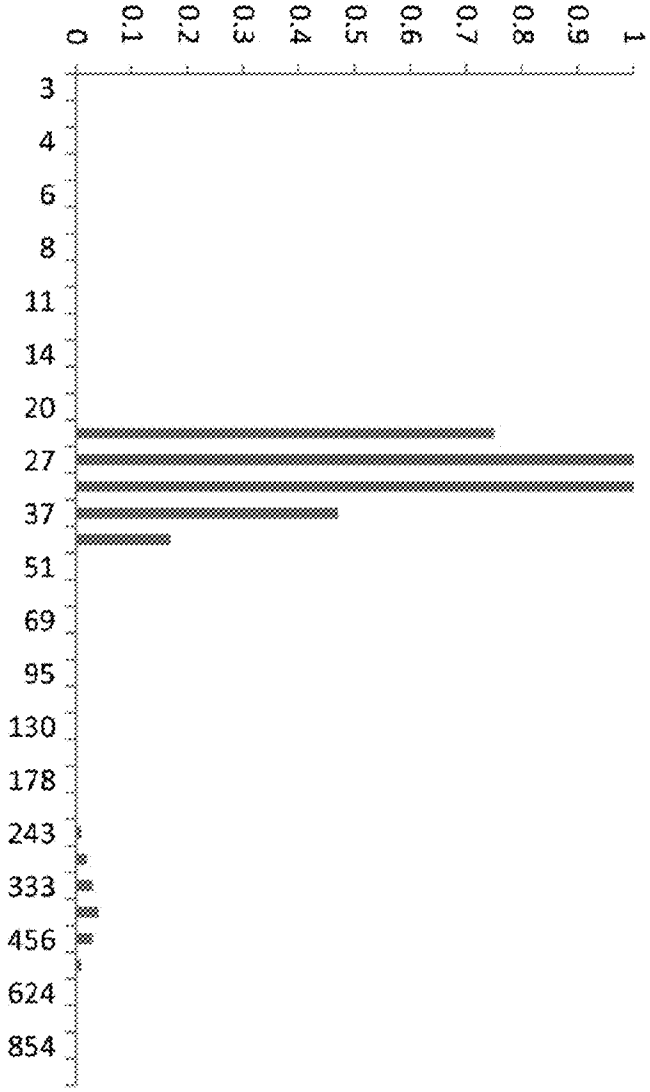
FIG. 11 is also a particle size distribution following use of one embodiment of the method of the present disclosure. Particles generated by milling of aluminum in acetonitrile at 350 rpm for 3 hours, then extracted from the milling dispersion using oleic acid. Large particles recovered after several oleic acid extractions.
Figure 12:
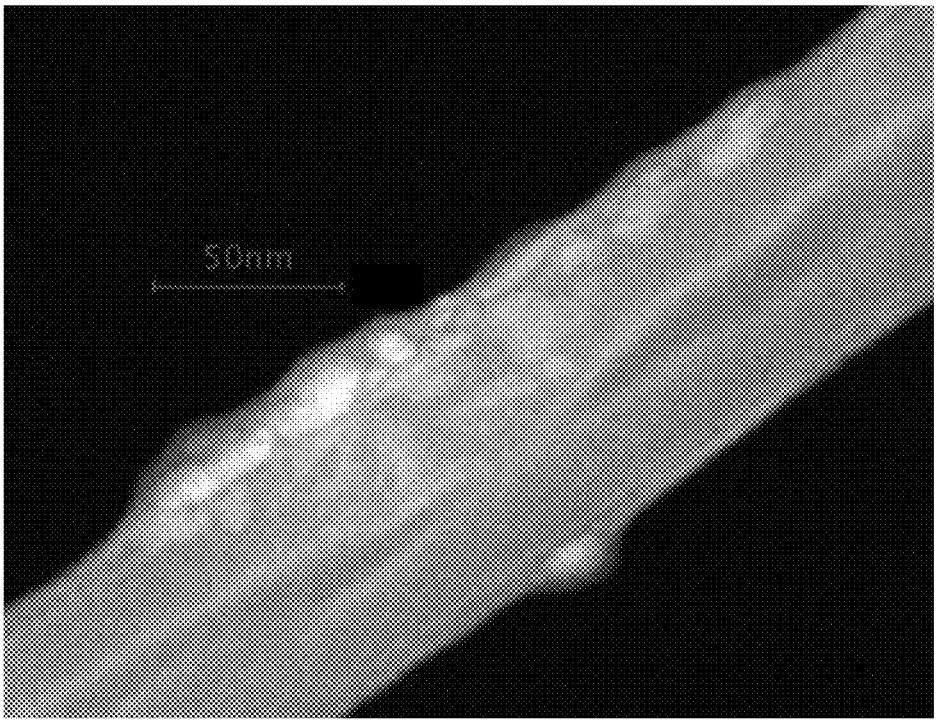
FIG. 12 is a TEM image of a supernatant following application of the method of the present invention. TEM image of particles generated by milling of aluminum in acetonitrile at 350 rpm for 3 hours, then extracted from the milling dispersion using oleic acid. Small particles recovered from first oleic acid extraction.
Figure 13:
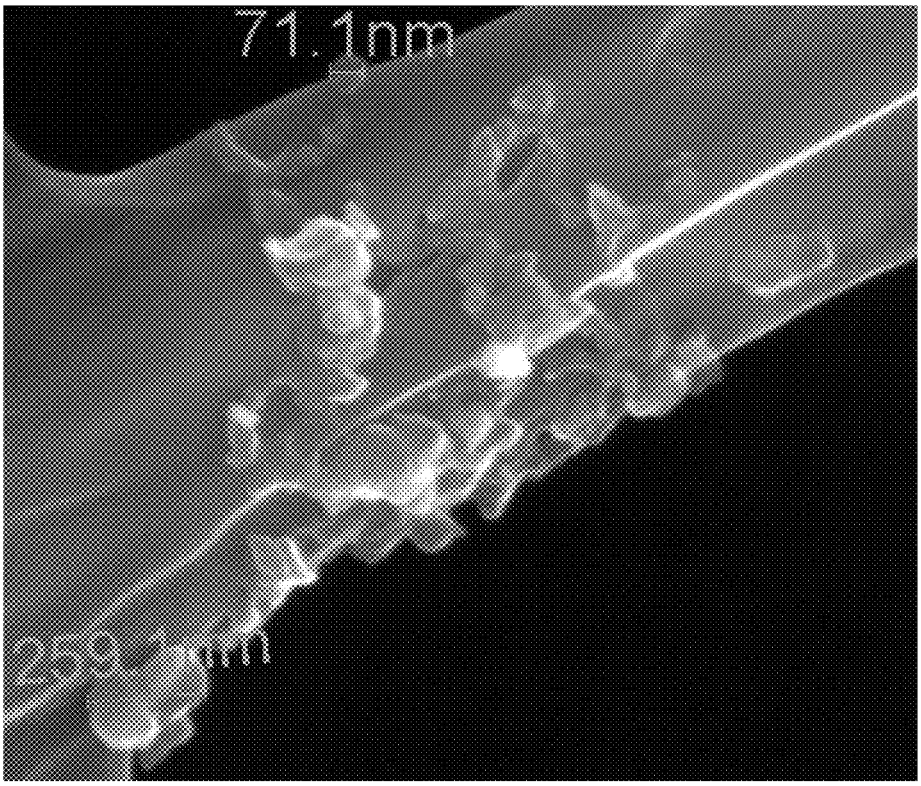
FIG. 13 is an SEM image of a supernatant following application of the method of the present invention. SEM image of particles generated by milling of aluminum in acetonitrile at 350 rpm for 3 hours, then extracted from the milling dispersion using oleic acid. Large particles recovered after several oleic acid extractions.

Control of Size Distribution:

With this process the size distribution of the particles can be altered by modifying several variables. Experimental results demonstrated that by varying the milling solvent (wetting agent), the size distribution of particles can be shifted. Influence on the size of the particles can be achieved by adjusting the milling speed as well as the duration of milling. It has also been observed that the surfactant and quite possibly the amount of a given surfactant can influence the size distribution. FIG. 10 shows a particle size distribution curve for one embodiment of the present invention. FIG. 11 shows another particle size distribution for another embodiment of the present invention. Similarly, FIGS. 12 and 13 show TEM and SEM images of supernatants with nanoparticles generated by the methods of the present invention. As shown in these images, the sizes of the nanoparticles generated by the methods can vary.

Surface Plating of a Substrate Ball:

For this type of milling process, one may coat or plate a substrate ball with a material that is either too expensive to purchase in as solid balls quantities, or unavailable in solid ball form. For example, gold, platinum, or palladium can be electroplated onto balls made from a base metal or metal compound. The density and hardness of the core ball material may be a useful parameter to use in controlling milling of plated balls.

Likewise for a material that is brittle and cannot be easily formed into a spherical ball, vapor deposition of the material of interest can be used to once again coat a substrate ball. These brittle materials would have different wear properties, but can produce nanoparticles in the same manner as both surface plated balls and solid material balls.

Producing Other Metal Nanoparticles with Controlled Properties

Homogeneous media body milling (HMBM) has been demonstrated for aluminum and iron, and in the case of aluminum have shown that by appropriate choice of milling conditions, particles can be generated in different size ranges, and with different levels of surface oxide (including un-oxidized), and with solubility/suspendibility in different liquids. These procedures can be generalized to other metals, and some examples are given below. The main differences are that the capping agent is chosen to have a functional group or groups that bind to the metal of interest, and the milling conditions (e.g. time, speed, ball size, solvent, core/shell material in the case of plated balls) are varied for the metal and application of interest.

Gold:

Gold nanoparticles are commonly used for tracer/sensor applications due to their relative inertness and optical properties. For example, HMBM can be used to generate gold nanoparticles by either milling gold bodies, such as milling balls, that have been electroplated with gold. Being that gold is relatively soft and ductile, milling parameters can be similar to those for aluminum. Capping agents suitable for gold nanoparticles frequently have a sulfur-containing group or groups, that bind to gold, and then the size and functional groups on the rest of the capping molecule are chosen to control solubility/suspendibility for the application of interest. For example, one can interact the gold, most often during the milling process, but optionally by addition after milling, with molecules such as octanethiol, dodecanethiol, 3,4 ethyenedioxythiophene, mercaptohexanoic acid, or 1-Mercapto-(triethylene glycol)methyl, although other capping agents may be suitable.

Palladium:

Palladium nanoparticles are excellent catalysts. Palladium can also undergo similar milling conditions to that of gold, but the capping agents would generally be different. For palladium, capping agents such as, but not limited to, polyhedral oligomeric silsesquioxane (POSS)-based amines, polyvinyl alcohol, sodium carboxymethylcellulose (CMC) and the like can be added either in situ or post milling.

Platinum:

Platinum is also an excellent catalyst, and would also undergo similar milling conditions to that of gold, but the capping agents would also be different. For platinum capping agents such as polyvinylpyrrolidone (PVP) and folic acid can be used for biological applications, and tetradecyltrimethylammonium bromide (TTAB) and oleylamine can be used for more industrial applications, and once again could be added both in situ and post milling.

Silver:

Silver is catalytically active, but silver nanoparticles also have strong optical resonances and are therefore of interest in sensing applications. Milling conditions are similar to those for gold, but the capping agents would again vary from the other precious metals. Silver capping agents can include, but are not limited to, sodium acrylate, oleylamine, citrate, starch, polyvinylpyrrolidone (PVP), dodecylamine, dodecane thiol and the like, which once again could be added in situ or post milling.

Iron/Iron Oxide:

Iron/Iron Oxide, or metals or metal oxides like Ni, Cr, etc. are harder materials, many of which can be interesting for applications like coatings, alloying, and magnetic materials. For hard dense metals like iron, the milling procedure can be different than for more ductile materials. HMBM for balls containing iron works with remarkable efficiency. This process generates very small iron nanoparticles (e.g. <10 nm) with very little evidence of anything bigger. The jar can be kept oxygen free to produce iron or allow oxygen in to produce iron oxide. Both of these products can be passivated/suspended with a variety of capping agents. The capping agents can be added either in situ or post milling, although adding them in situ has proven effective. Carboxylic acids, amines, thiols, oleylamine, oleic acid, benzyl amine, polyvinylpyrrolidone (PVP), and the like can be used as suitable capping agents to both promote suspension and/or passivate the particles.

allowing the newly formed metal nanoparticles to oxidize post milling. Zirconium oxide nanoparticles have drawn a lot of interest because they are isoelectronic with palladium and may possess similar catalytic properties, as well as many other applications, and can be generated in the same manner. Evidence has shown that this process (milling metal balls, and allowing the nanoparticles to oxidize, either during milling, or afterward) can generate very small aluminum oxide particles. Such oxidation can be similarly applied to zirconium oxide, titanium oxide, and oxides of any metal that readily oxidizes when in nanoparticle form. In such cases, capping agents would not be needed, unless required for solubility of the final nanoparticles. Such solubility enhancing capping agents can be a compound which binds to metal oxide surfaces, such as polyvinylpyrrolidone (PVP) or citrate, although other materials can also be suitable.

Ionic Liquids:

HMBM can also be used to generate nanoparticles that are immediately post milling or in situ suspended in ionic liquids. A list of metal nanoparticles that have been generated by various means and suspended in various ionic liquids is provided in Table II. In the present invention, the particles can be generated by HMBM, and coated with ionic liquid or with other surfactant to control suspendibility in the ionic liquid of interest. One aspect of particular interest is aluminum nanoparticles for use in IL-based rocket propellants.

TABLE II

| Metal | Metal salt precursor | Reducing agent | IL[a] | M-NP size, average diameter (standard deviation) [nm] |
|---|---|---|---|---|
| Ru | Ru(COD)(COT)[b] | $H_2$ | $BMIm^+TF_2N^-$ | 0.9-2.4 |
| | Ru(COD)(COT)[b] | $H_2$ | $BMIm^+BF_4^-$, $BMIm^+PF_6^-$, $BMIm^+TfO^-$ | 2.6(4) |
| Rh | $RhCl_3$—$3H_2O$ | $H_2$ | $BMIm^+PF_6^-$ | 2.0-2.5 |
| | $[Rh(COD)\text{-}\mu\text{-}Cl]_2$[b] | $H_2$ + laser radiation | $BMIm^+PF_6^-$ | 7.2(1.3) |
| Ir | $[Ir(COD)Cl]_2$[b] | $H_2$ | $BMIm^+BF_4^-$, $BMIm^+PF_6^-$, $BMIm^+TfO^-$ | 2-3 |
| | $[Ir(COD)_2[BF_4,]Ir(COD)Cl]_2$[b] | $H_2$ | 1-alkyl-3-methyl-$Im^+BF_4$ | Irregular 1.9(4), 3.6(9) |
| Pd | $H_2PdCl_4$ | $NaBH_4$ | $HSCO_3Im^+Cl^-$[c] | Nanowires |
| | $PdCl_2$ | $H_2$ + laser radiation | $BMIm^+PF_6^-$ | 4.2(8) |
| | $Pd(acac)_2$ | $H_2$ | $BMIm^+PF_6^-$ | 10(2) |
| Pt | $Na_2Pt(OH)_6$ | $NaBH_4$ | $HSIm^+A^-$ or $HOIm^+A^-$[d] | 3.2(1.1), 2.2(2), 2.0(1) |
| | $H_2PtCl_6$ | $NaBH_4$ | $CMMIm^+Cl^-$[e], $AEMIm^+Br^-$[f] | 2.5 |
| | $PtO_2$ | $H_2$ | $BMIm^+BF_4^-$, $BMIm^+PF_6^-$ | 2-3 |
| Ag | $AgBF_4$ | $H_2$ | $BMIm^+BF_4^-$ | 2.8 |
| | | | $BMIm^+PF_6^-$ | 4.4 |
| | | | $BMIm^+TfO^-$ | 8.7 |
| | | | $BtMA^+Tf_2N^-$ | 26.1 |
| Au | $KAuCl_4$ | $SnCl_2$ | $BMIm^+BF_4^-$ | 2.6-200 |
| | $HAuCl_4$ | $Na_3$citrate/$NaBH_4$ | $EMIm^+EtSO_4^-$ | 9.4 |
| | | $Na_3$citrate | $EMIm^+EtSO_4^-$ | 3.9 |
| | | Ascorbic acid | $EMIm^+EtSO_4^-$ | Nanorods |
| | $HAuCl_4 \bullet 3H_2O$ | $H_2NNH_2 \bullet H_2O$ (hydrazine monohydrate) | $TriMIm^+MeSO_3^-$[g] | ~7.5 |
| | $HAuCl_4$ | $NaBH_4$ | $ShexMIm^+Cl$-[h] | 5.0 |
| | $HAuCl_4$ | $NaBH_4$ | $HSIm^+A^-$ or $HOIm^+A^-$[d] | 3.5(7), 3.1(5), 2.0(1) |
| | $HAuCl_4$ | $NaBH_4$ | $CMMIm^+Cl^-$[e], $AEMIm^+Br^-$[f] | 3.5 |
| | $HAuCl_4$ | $Na_3$citrate | $CMMIm^+Cl^-$[e], $AEMIm^+Br^-$[f] | 23-98 |
| | $HAuCl_4$ | Cellulose | $BMIm^+Cl^-$ | 300-800 |

Other Metals:

This is a versatile method that could easily be adapted to almost any metal. With the proper milling conditions, surfactants, and wetting agent this process can work for any given metal.

Zinc or Other Metal Oxides:

Zinc oxide nanoparticles, are interesting for use in electrochemical sensors, and may be produced by HMBM of zinc or zinc-plated ball either in an oxidizing atmosphere, or by However, this process is not limited to the ionic liquids listed. Further, the ionic liquids can optionally act as capping agents.

Alloying:

HMBM can also be used to perform mechanical alloying or intimate mixing of nanomaterials, by milling together balls of different materials under conditions where the resulting nanoparticles aggregate to form alloy or multi-component particles. This process can be most effective with metals of similar hardness and ductility, but the process can work using metals of different hardness and ductility. Varying the parent materials, the speed of milling, the duration of milling, the solvent, surfactant, and varying the ball sizes for parent materials can be done for each combination. Suitable alloy combinations can include, but not limiting to, manganese-ferrite, gold-silver, gold-palladium-platinum, zirconium-hematite, iron-cobalt, aluminum-magnesium, and aluminum nickel.

EXAMPLES

Example 1

Production of Aluminum Nanoparticles Using Homogeneous Milling

Aluminum feedstock of 5/16" and 280 grams of mass as the milling body was mixed with 100 ml acetonitrile as the milling agent and 5 ml of benzylamine as an initial capping agent. The milling matrix was milled at 350 rpm for about 180 minutes to produce several grams of unoxidized aluminum powder of about 50 nm in size. The aluminum powder was sonicated with oleic acid and then resuspended in hexane.

FIG. 5 is an SEM micrograph of aluminum nanoparticles drop cast onto a TEM grid. Individual nanoparticles are apparent with no substantial agglomeration or apparent cold-welding. FIG. 6 is a graph of mass percent of non-oxidized aluminum. Due to small oxygen contamination in the glove box some of the formed aluminum nanoparticles become oxidized. It is noted that when the particles are washed in hexane, water can be added such that particles settle and disperse into the water phase.

Figure 7A:
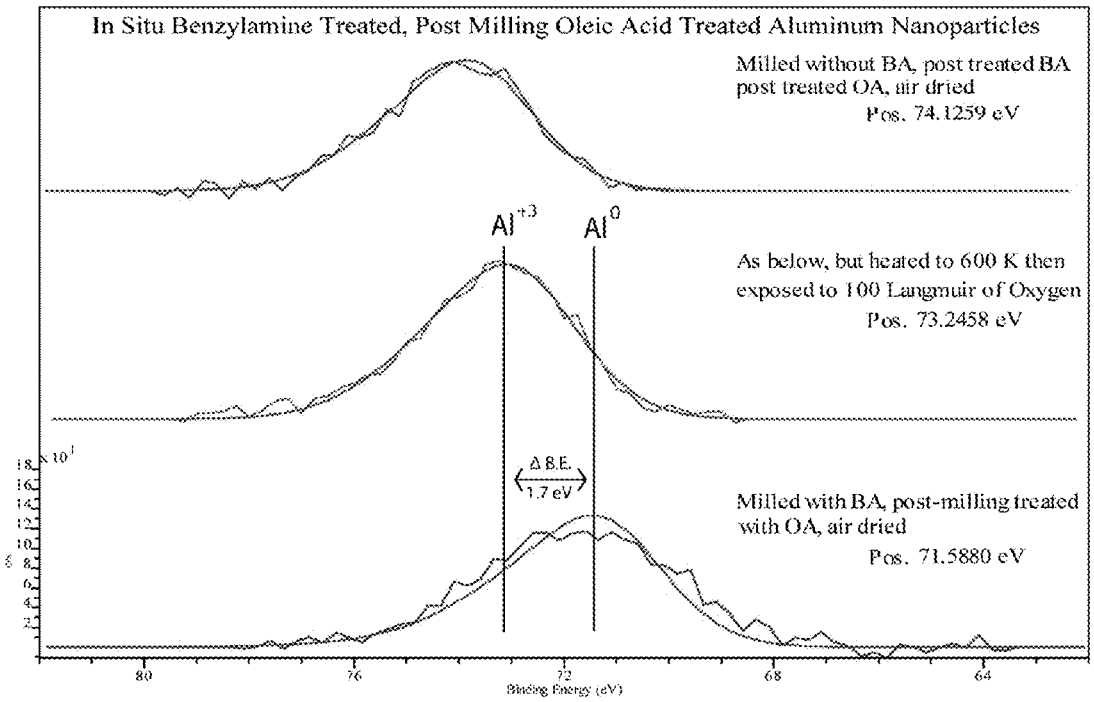
FIG. 7A is a graph of several XPS measurements which evidence un-oxidized nanoparticles that are air stable.

FIG. 7A is a graph of several XPS measurements which evidence un-oxidized particles that are air stable. From bottom to top, the figure shows lack of oxidation in as-prepared, air-dried aluminum nanoparticles that were coated with benzylamine during milling, then exposed to oleic acid post milling. The middle frame shows that after the particles are heated in vacuum to remove or destabilize the capping layer, they oxidize readily upon exposure even to millions of times less oxygen than the as-deposited sample saw during air drying. The top frame shows that in milling without benzylamine, and simply exposing the particles to benzylamine, and then oleic acid after milling, the aluminum oxidizes in the process of air drying for analysis. There is substantial oxidation, as indicated by the shift in the XPS peak position. Comparison of the three spectra shows that the organic layer does protect the un-oxidized particles during air exposure, and that when the organic layer is disrupted by heating, the particles oxidize readily, as would be desired for a fuel/propellant/explosive application. It also shows that by exposure to oxygen, the peak shifts from an unoxidized state to an oxidized state. By deduction, the original must be unoxidized, since the position of the oxidized peak is in its highest state.

Figure 7B:
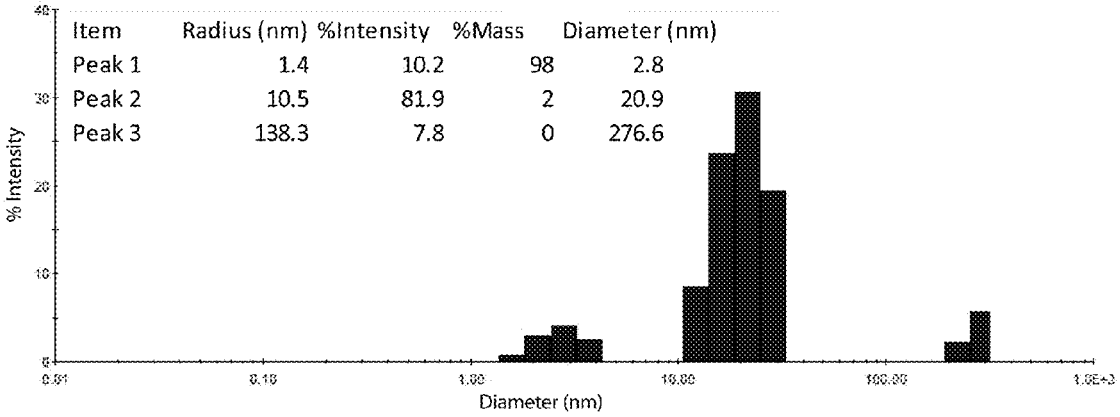
FIG. 7B is a graph of dynamic light scattering showing mass-weighted size distribution.

FIG. 7B is a graph of dynamic light scattering showing the mass-weighted size distribution. This shows that 98% of the mass of the sample is in the very small nanoparticles, and there is almost none in the size range above 100 nm. Data for % mass numbers look different from the raw intensities (% intensities), because for very small particles below 10 nm, the DLS method has reduced detection efficiency. The DLS instrument used to produce FIG. 7B includes software to automatically correct for this discrimination, to get a more accurate estimate for actual mass-weighted size distribution.

Figure 8:
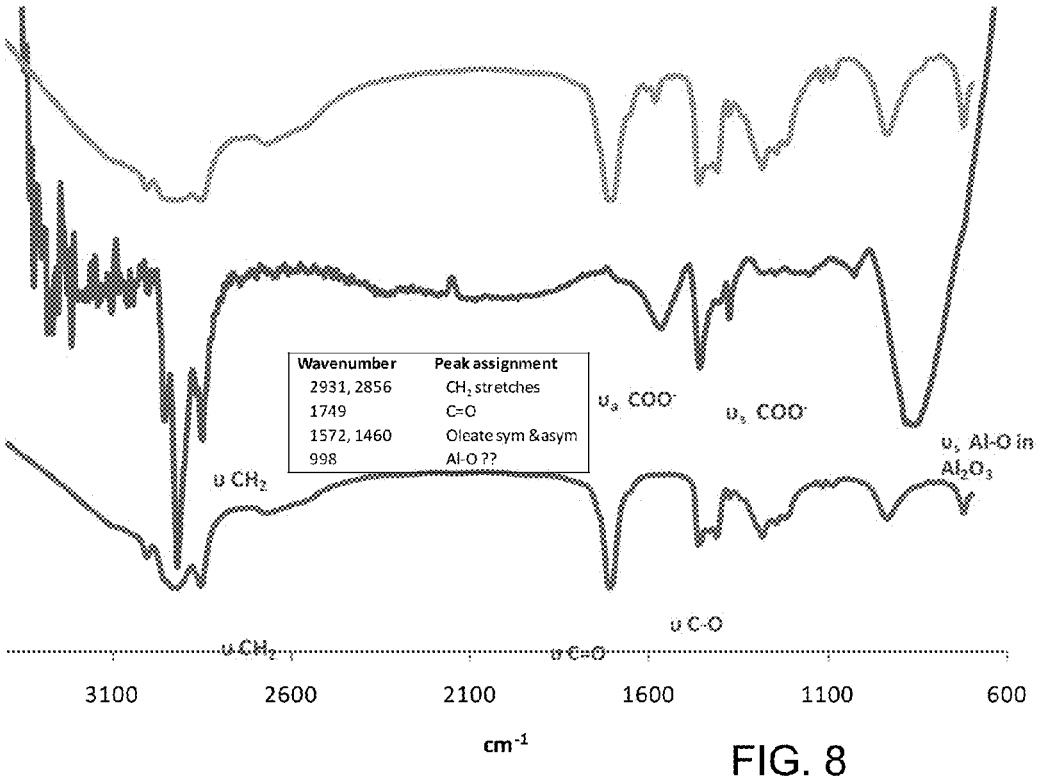
FIG. 8 is an FTIR of the aluminum powder sonicated with oleic acid and washed in hexane.

FIG. 8 is an FTIR of the aluminum powder sonicated with oleic acid and washed in hexane. Oleic acid interaction via oleate binding is observed. The upper curve is sonicated powders with oleic acid and unwashed. The middle curve is sonicated powders with oleic acid as sediments. The lower curve is oleic acid as a reference.

Figure 9:
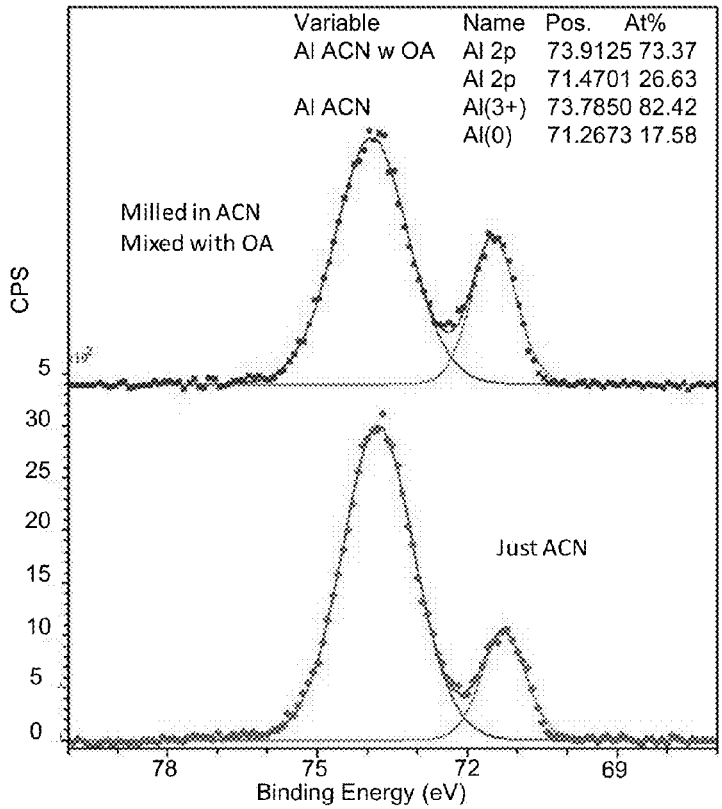
FIG. 9 is a spectra of naked aluminum compared to aluminum coated with oleic acid.

FIG. 9 is a spectra of naked aluminum compared to aluminum coated with oleic acid. From this is shown that oxidation of Al powders was decreased with oleic acid interaction. Washing the particles with hexane removes most of the oleic acid exposing Al surfaces. The in situ treatment of the nanoparticles with benzylamine moderates reaction with oxygen present in the oleic acid sufficient to make them dispersible in non-polar solvents, and make them air stable.

Example 2

Production of Copper Nanoparticles Using Homogeneous Milling

Short cylindrical pieces of copper feedstock are provided as the milling bodies. The milling bodies re placed in a planetary mill with a 100 ml of toluene as the milling agent. The milling matrix is milled at 350 rpm for about 180 minutes to produce copper nanoparticles.

Example 3

Production of Aluminum Nanoparticles Using Homogeneous Milling

Figure 14A:
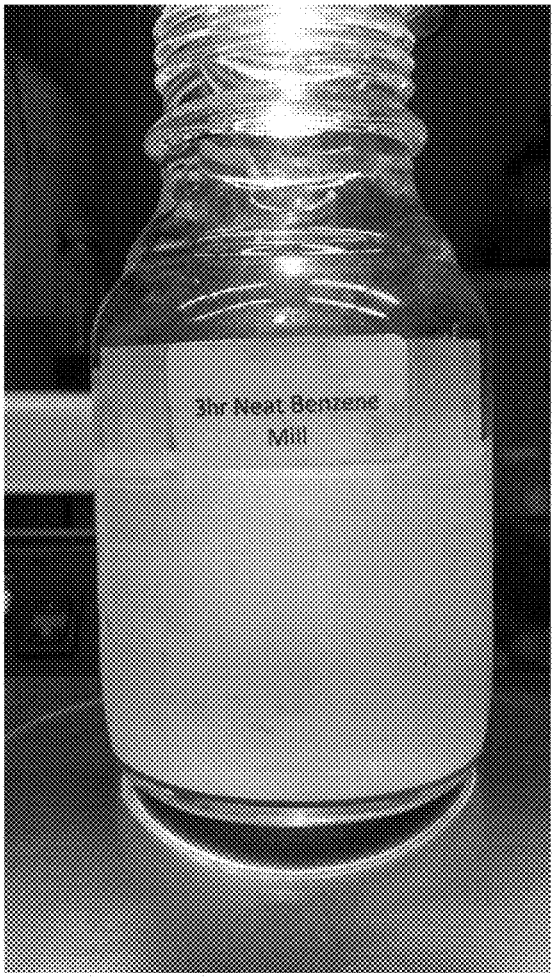
FIGS. 14A-14F are photographic images of nanoparticle-containing supernatant compositions following homogenous milling of milling bodies in various milling solvents.
Figure 14B:
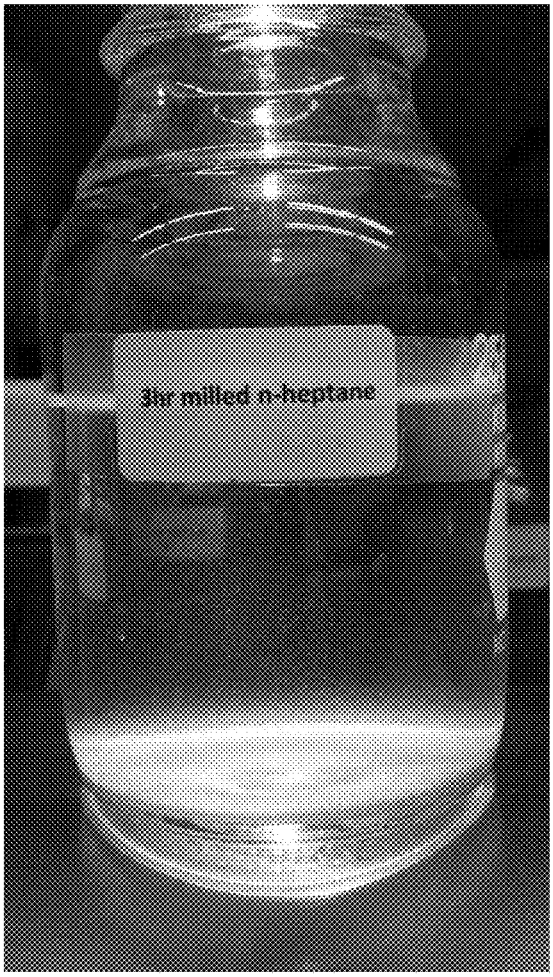
Figure 14C:
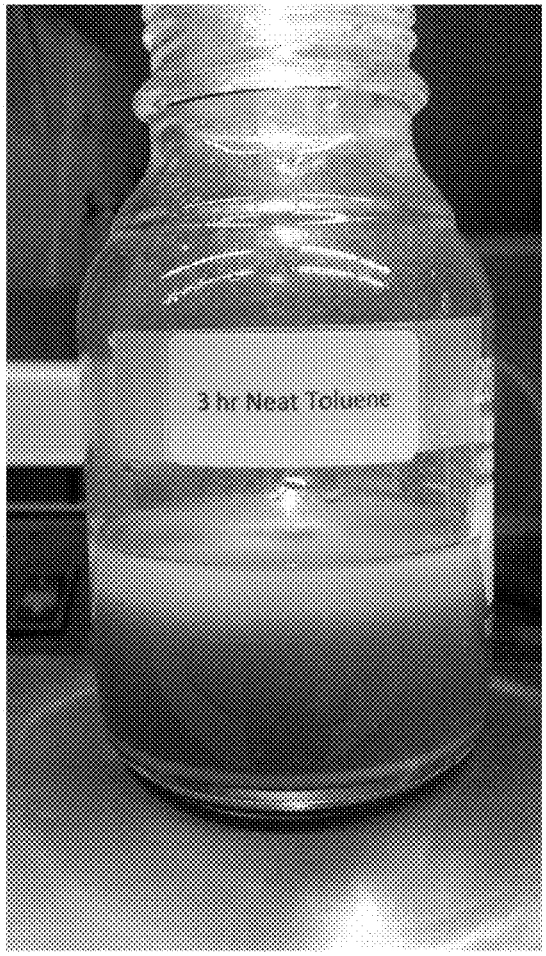
Figure 14D:
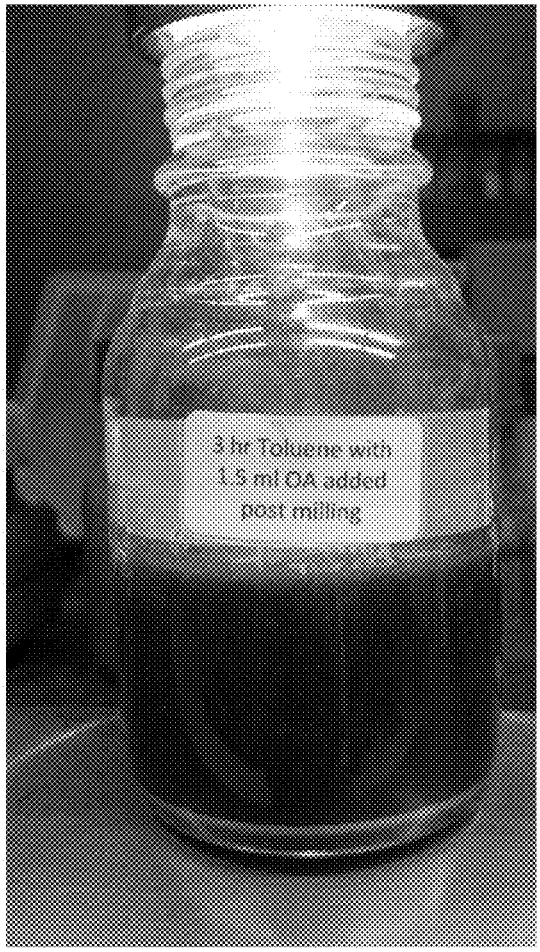
Figure 14E:
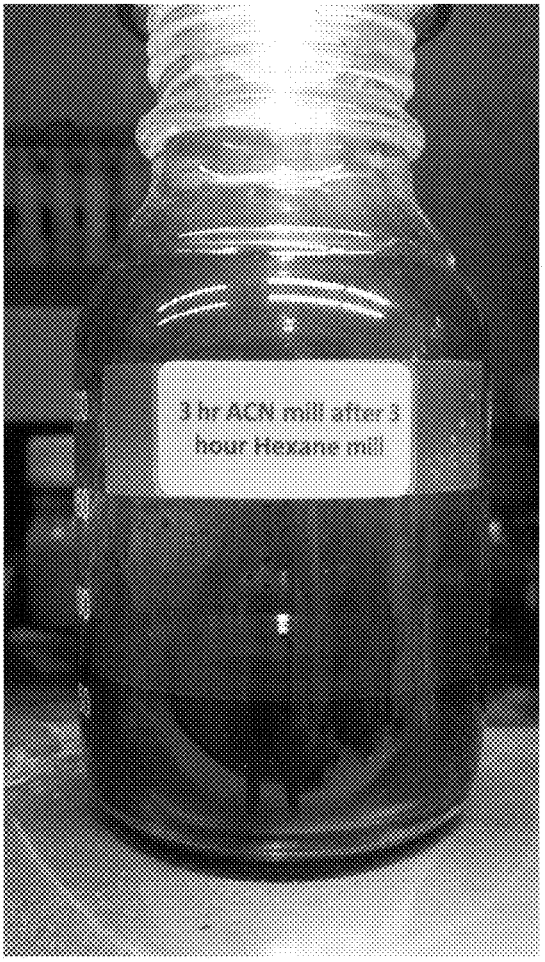
Figure 14F:
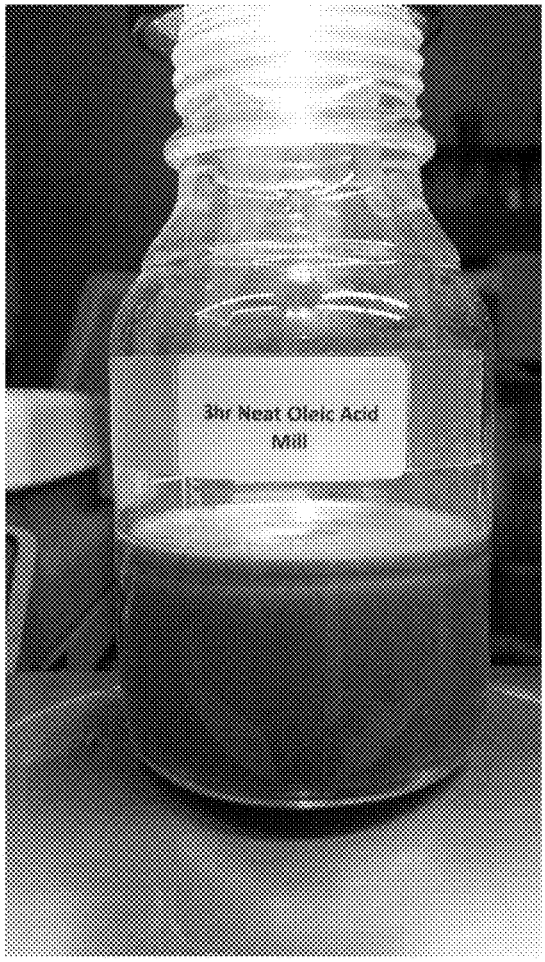

Spherical shaped milling bodies of compositionally homogeneous aluminum were milled in separate but equal amounts of each of the following solvents: benzene, n-heptane, acetonitrile, oleic acid, and toluene. Each sample was milled for 180 minutes after which the supernatant was placed in clear glass bottles and photographed. As can be seen in FIGS. 14A-F, the bodies that were milled in benzene (FIG. 14A) and heptane (FIG. 14B) produced supernatants that were clear or substantially clear with little to no nanoparticles. In contrast, the bodies milled in toluene (FIG. 14C), acetonitrile (FIG. 14E) and oleic acid (FIG. 14F) all each produced dark and cloudy supernatants that were laden with the formed nanoparticles. FIG. 14D shows a photographic image of the toluene supernatant following post-milling extraction with the capping agent oleic acid.

The foregoing detailed description describes the invention with reference to specific exemplary embodiments and examples. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

What is claimed is:

1. A method of producing nanoparticles, comprising: milling a plurality of milling bodies in the presence of a milling agent sufficient to produce the nanoparticles from exterior surfaces of the plurality of milling bodies, wherein the milling is substantially free of added solids other than the plurality of milling bodies.

2. The method of claim 1, wherein the exterior surfaces comprise at least one of aluminum, iron, steel, gold, palladium, platinum, silver, nickel, chromium, zinc, oxides thereof, and alloys thereof.

3. The method of claim 1, wherein the plurality of milling bodies are compositionally homogeneous.

4. The method of claim 1, wherein the plurality of milling bodies are core-shell structures.

5. The method of claim 4, wherein the exterior surfaces of the core-shell structure are formed of a precious metal.

6. The method of claim 1, wherein the plurality of milling bodies include a first plurality of milling bodies having exterior surfaces of a first metal and a second plurality of milling bodies having exterior surfaces of a second metal which is different than the first metal, such that the nanoparticles comprise both the first and second metals.

7. The method of claim 1, wherein the plurality of milling bodies are substantially spherical in shape.

8. The method of claim 1, wherein the plurality of milling bodies are substantially cylindrical in shape.

9. The method of claim 1, wherein the plurality of milling bodies have an initial size such that their largest dimension has a measure of about 0.125 inch to about 0.5 inch.

10. The method of claim 1, wherein the nanoparticles have an average diameter of less than about 500 nm.

11. The method of claim 1, wherein the nanoparticles have an average diameter of less than about 150 nm.

12. The method of claim 1, wherein the milling agent is has a dipole moment of greater than 0.0.

13. The method of claim 1, wherein the milling agent has a dipole moment of greater than 0.3.

14. The method of claim 1, wherein the milling agent has at least one moiety selected from the group of a carboxylic acid, a ketone, an alcohol, a nitrile, an amine, and combinations thereof.

15. The method of claim 1, wherein the milling agent includes at least one of toluene, acetonitrile, diethylamine, 3-pentanone, methylene chloride, benzylamine, acetone, ionic liquid, ethanol, and alcohols.

16. The method of claim 1, wherein the milling agent is substantially non-reactive with the nanoparticles and the milling bodies.

17. The method of claim 1, wherein the milling agent is free of oxygen.

18. The method of claim 1, further comprising providing a capping agent which binds to the nanoparticles sufficient to substantially reduce oxidation of exposed surfaces of the nanoparticles.

19. The method of claim 18, wherein the capping agent is added during the milling.

20. The method of claim 18, wherein the capping agent includes at least one of oleic acid, octanethiol, dodecanethiol, 3,4-ethylenedioxythiophene, mercaptohexanoic acid, 1-mercapto-(triethylene glycol) methyl, polyhedral oligomeric silsesquioxane (POSS)-based amine, polyvinyl alcohol, sodium carboxymethylcellulose (CMC), polyvinylpyrrolidone (PVP), folic acid, tetradecyltrimethylammonium bromide (TTAB), oleylamine, sodium acrylate, citrate, starch, dodecylamine, benzylamine, carboxylic compounds, amines, and thiols.

21. A method of producing nanoparticles, comprising: milling a plurality of milling bodies in the presence of a milling agent sufficient to produce the nanoparticles from exterior surfaces of the plurality of milling bodies, wherein the plurality of milling bodies include a first plurality of milling bodies having exterior surfaces of a first metal and a second plurality of milling bodies having exterior surfaces of a second metal which is different than the first metal, such that the nanoparticles comprise both the first and second metals.

22. The method of claim 21, wherein the exterior surfaces comprise at least one of aluminum, iron, steel, gold, palladium, platinum, silver, nickel, chromium, zinc, oxides thereof, and alloys thereof.

* * * * *